United States Patent [19]

Bloomingdale

[11] 4,204,723

[45] May 27, 1980

[54] SAFETY PLUG CLIP

[76] Inventor: Jack W. Bloomingdale, 950 Orchard Ave., Camp Hill, Pa. 17011

[21] Appl. No.: 6,574

[22] Filed: Jan. 26, 1979

[51] Int. Cl.[2] ..... H01R 13/44

[52] U.S. Cl. ..... 339/36

[58] Field of Search ..... 339/36, 37, 82

[56] References Cited

U.S. PATENT DOCUMENTS

| | | | |
|---|---|---|---|
| 3,345,600 | 10/1967 | Scherer | 339/37 |
| 3,416,123 | 12/1968 | Husebo | 339/37 |
| 3,422,389 | 1/1969 | Husebo | 339/37 |
| 3,539,968 | 11/1970 | Tunstall et al. | 339/37 |

*Primary Examiner*—Joseph H. McGlynn
*Attorney, Agent, or Firm*—Thomas Hooker

[57] ABSTRACT

A safety plug clip adapted to be inserted through bores in the ends of line cord plug blades includes a pair of normally diverging legs resiliently connected to each other and two oppositely faced lock surfaces such that the legs may be pushed together sufficiently to permit insertion through the bores. Upon release of the legs, the lock surfaces are in close engagement with oppositely facing surfaces on the blades to lock the clip in place and prevent further movement in either the insertion or withdrawal direction. One leg extends through both bores to stabilize the clip on the blades.

9 Claims, 17 Drawing Figures

SAFETY PLUG CLIP

The invention relates to the safety devices for attachment to electrical line cord plugs so that the plugs cannot be inserted into female electrical outlets. In this way, positive deactivation of the electrical device powered by electricity passing through the line cord plug can be obtained. These safety devices are particularly useful in deactivating electrical devices which may be accidentally plugged in to sockets by children. Further, the safety device prevents insertion of the plug blades into an outlet socket and eliminates the risk of a child of being shocked or even electrocuted by contact with partially inserted but electrically active blades.

Safety attachments for preventing insertion of line cord plugs into electrical sockets are well known in the art and a number of patents disclose safety devices of this type including a pin extending through the bores formed in the end of line cord plug contact blades. See U.S. Pat. Nos. 3,345,600, 3,416,123, 3,422,389 and 3,539,968. In these patents the safety device is a multipart assembly attached to the plug and including as one member a pin that merely extends loosely through the bores in the blades. The pin does not engage the blade surfaces and does not lock against the blade surfaces. The pins are held in place by a second surrounding member and a connection between the pin and this member. Conventionally, this connection is provided by a padlock. The resultant safety devices are expensive to manufacture and difficult to attach to a line cord plug because of the multi-step operation required. Their bulk makes them unsuitable for home use and their expense inhibits their purchase, despite their safety advantages. Insertion and removal require separate keys and can be accomplished by children.

The invention relates to clip-type safety devices for mounting on plug blades in the bores extending through the ends of the blades and including a pair of legs secured together by a resilient connection so that the legs are normally divergent from each other away from the connection and can be moved toward each other to permit insertion of the clip through the blade bores. Following insertion of the clip and release of the stressed legs one leg extends through both bores and the resilient connection biases the opposite or outer surfaces of the legs against opposite sides of a bore to stabilize the clip in place. Oppositely facing lock surfaces on the clip engage surfaces of the blade to prevent further movement in the insertion or withdrawal directions and thereby lock the clip in place against accidental withdrawal. During insertion, the collapse of the legs toward each other moves the lock surface facing in the direction of withdrawal movement below its locking position to permit it to pass through a bore. When released, flexing of the legs apart moves this surface into the locking position opposite the blade surface. The clip may be withdrawn from the plug by manual depression of the legs toward each other and movement of the clip in a withdrawal direction opposite to the insertion direction.

The application includes a number of embodiments of my safety clip wherein different types of locking surfaces are disclosed. In a first embodiment the locking surfaces are formed on the interior sides of recesses in the outer surfaces of the legs. In this and other embodiments the end surface of a short leg prevents insertion of the clip beyond the locked position.

In a second embodiment the bight portion includes laterally extending shoulders to either side of both legs. These shoulders, in combination with a bight portion on the short leg prevent further insertion of the clip. A locking surface is provided on the free end of the short leg and engages the interior surface of a blade to prevent withdrawal of the clip from the locked position. Other embodiments of the invention use a wide bight portion as previously described with locking recess shoulders, recesses and projections formed in the legs to engage the sides of the blades and hold the clip in the locked position.

In two embodiments of the invention the connection between the legs is moved through one bore and the short leg snaps out of the bore to engage the interior surface of the blade and, in combination with the locking surface on the free end of the long leg, locks the clip in position. In all embodiments the long leg extends completely through both bores to stabilize the clip in place on the blades.

In contrast to the prior art pin-type safety devices, my one piece safety clips are small and inexpensive to manufacture and provide the desired safety features by preventing plugs from being inserted into electrical sockets. The clips are easily inserted into the bores on the ends of the plug blades and locked into place by adults but require considerable strength and manual dexterity in order to be removed. These features assure that young children cannot accidentally remove the clips from plugs that have been purposely deactivated by adults and provide the assurance of safety sought by every parent or person responsible for the safety of children. Electrical devices of all types are easily and positively deactivated so that they cannot be plugged in. This feature prevents not only deactivation of the electrical device but also assures that children playing with the plugs cannot partially insert a plug into the socket and then contact the electrically activated blades.

Other objects and features of the invention will become apparent as the description proceeds, especially when taken in conjunction with the accompanying drawings illustrating the invention, of which there are two sheets.

IN THE DRAWINGS

FIGS. 1A, 1B, 1C and 1D are views illustrating a first embodiment of the invention with FIG. 1A being a perspective view of a plug and a safety clip in position to be inserted onto the blades of the plug, FIG. 1B being similar to FIG. 1A but with the clip inserted on the plug blades, FIG. 1C being a sectional view through the blades showing the clip in the mounted position and FIG. 1D being a sectional view along lines 1D—1D of FIG. 1C;

Figure 2A:
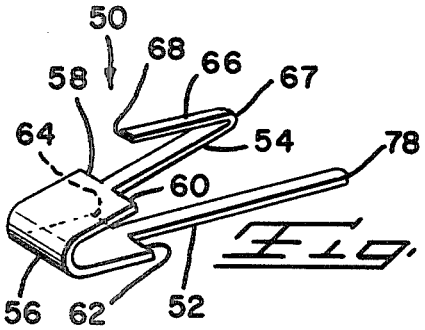
FIGS. 2A and 2B are views of a second embodiment of the invention with FIG. 2A being a perspective view of the clip and FIG. 2B illustrating such clip inserted onto a pair of plug blades.
Figure 2B:
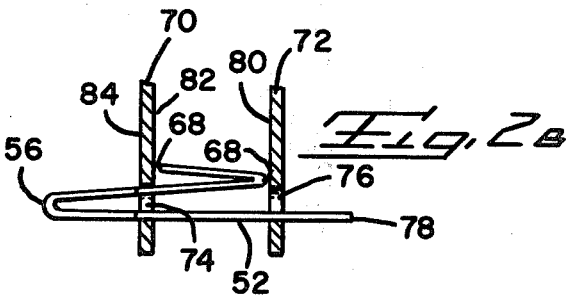

Paired FIGS. 4A and 4B, 5A and 5B, 6A and 6B and 7A and 7B are similar to FIGS. 2A and 2B and, respectively, illustrate fourth, fifth, sixth and seventh embodiments of the invention.

Referring to the first embodiment of the invention, conventional line cord plug 10 supports a pair of spaced parallel contact blades 12 and 14 formed of flat metal stock. The plug is attached to the end of a line cord 16 and surrounds electrical connections between the conductors in the cord and the blades 12 and 14. The free end of each blade includes a cylindrical bore 18, 20 extending through the thickness thereof. Bores 18 and 20 are axially aligned.

Safety clip 22 is preferably formed of resilient conductive metal stock and includes a pair of legs 24 and 26 and a connecting U-shaped bight portion 28. As illustrated in FIG. 1, the clip 22 is preformed so that the legs 24 and 26 normally extend away from each other outwardly of the bight 28. A pair of spaced inwardly extending lock recesses are formed in the outer surface of long leg 24 facing away from leg 26. A single lock recess 34 extends inwardly on the surface of short leg 26 away from leg 24. The lock recesses 30 and 34 are equally distant from the bight portion 28.

While clip 22 is preferably formed of metal material it may also be formed of a resilient nonconductive insulating material, such as a plastic.

Figure 1A:
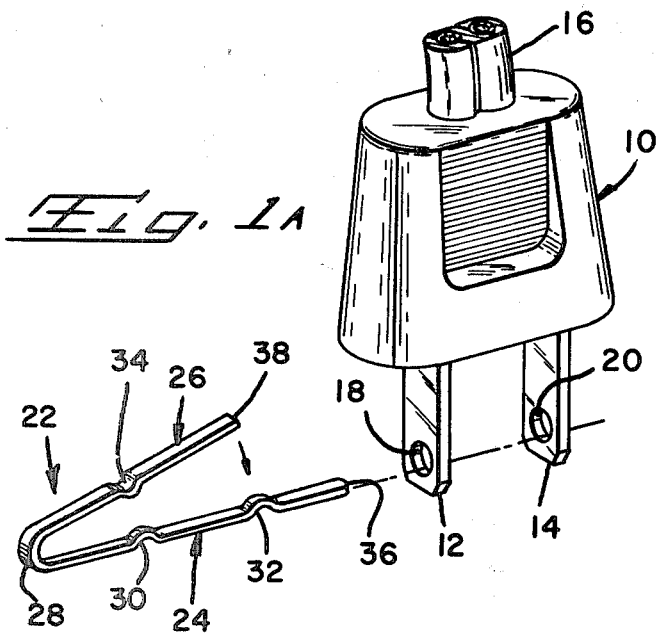
Figure 1B:
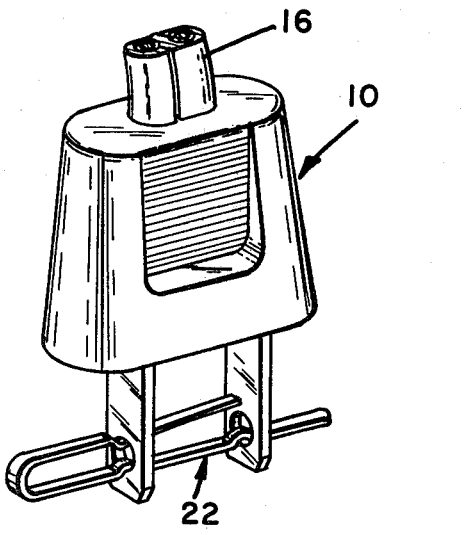
Figure 1C:
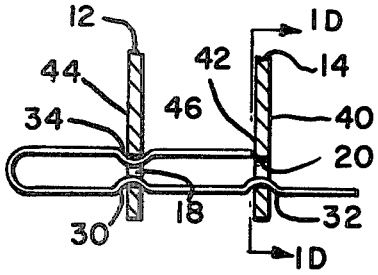
Figure 1D:
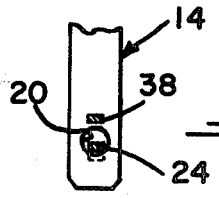

Clip 22 is mounted on plug blades 12 and 14 by first compressing the legs 24 and 26 so that they touch each other and then moving the end 36 of long leg 24 through bores 18 and 20 and the end 38 of short leg 36 through bore 18 to the position of FIGS. 1B and 1C. The legs are then released to expand with respect to the bight 28 and seat the lock recesses against the sidewalls of bores 18 and 20 as illustrated in FIG. 1C. The interior surfaces of the recess 32 engages both the outer and inner surfaces 40 and 42 of blade 14. The inner surface of recess 30 engages both the outer and inner surfaces 44 and 46 of blade 12 and the inner surface of recess 34 likewise engages the outer and inner surfaces 44 and 46 of blade 12. In this embodiment the engagement between the interior surfaces of each recess and the inner and outer surfaces of the blades at the bores 18 and 20 locks the clip in place and prevents undesired movement of the clip in either the insertion or withdrawal directions. With the clip attached to the blades the free end 38 of leg 26 abuts the interior surface 42 of blade 14. When end 38 hits surface 42 the clip is fully inserted and may be released to seat the recesses 30, 32 and 34 over the edges of bores 18 and 20 to thereby lock the clip in place on the blades.

With the clip in place the spring tension on the legs biases the recess against the bores to establish electrical connections between the clip and the two blades. Leg 24 extends through both bores and stabilizes the clip in place on the blades.

The three recesses provide three separate locking engagements with the blades which provide highly desirable redundant locking connections between the blade and clip. The engagement between end 38 of leg 26 and the interior surface 42 of blade 14 further prevents movement of the clip in the insertion direction. These redundant connections between the clip and blades lock it in place on the plug and assure that it cannot be accidentally removed.

Removal of the clip from the plug is achieved depressing the legs so that the clearance between the recesses is such to permit withdrawal in the direction opposite to the insertion direction. Each leg 24, 26 must be moved in a direction toward the opposite leg from the position of FIG. 1C in order to clear its respective recess or recesses from the sides of the bores. This operation requires considerable manual dexterity and strength. Young children lack this degree of dexterity and strength so that once the clip is positioned on the plug it is permanently attached to the plug and cannot be removed by young children.

With the clip in position, it is impossible to insert the plug blades into a conventional electrical outlet thereby assuring that the appliance or electrical apparatus powered by line cord 16 is deactivated while the clip is in place.

The safety clip 50 of FIGS. 2A and 2B includes a pair of legs 52 and 54 joined together by a bight portion 56. The bight portion 56 extends laterally of both the legs to provide shoulders 58 and 60 to either side of short leg 54 and shoulders 62 and 64 to either side of long leg 52. Legs 52 and 54 normally diverge outwardly of the bight portion. A reverse bend locking extension 66 joins the free end of short leg 54 at bend or bight 67 and includes a free end 68 located a short distance above shoulders 58 and 60. The extension 66 is slightly shorter than leg 54.

Safety clip 50 is attached to the blades 70 and 72 of a clip similar to clip 10 having coaxial bores 74 and 76 extending through their thicknesses adjacent the free ends of the blades. In order to insert the clip 60 the extension 66 and short leg 54 are both moved toward long leg 52 so that all three are essentially flush upon each other following which the free end 78 of leg 52 is piloted through the bores 74 and 76 until bight portion 67 engages the inner surface 80 of blade 72. When positioned thusly, the extension and legs are released so that end 68 of extension 66 is moved above bore 78 and is opposite the interior surface 82 of blade 70 to prevent withdrawal of the clip. Shoulders 58, 60, 62 and 64 engage exterior surface 84 of blade 70 and bight 67 engages surface 80 to prevent over-insertion of the clip. In this way, the clip is locked in place on the plug to prevent insertion of the blades into a power socket and cannot be accidentally removed.

Figure 3A:
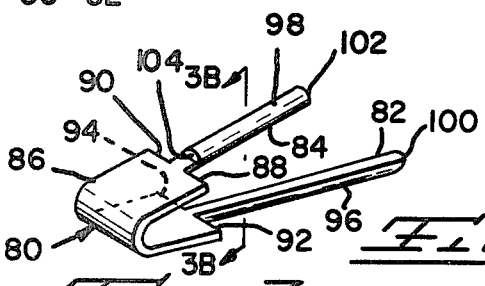
FIGS. 3A, 3B and 3C illustrate a third embodiment of the invention with FIG. 3A being a perspective view of the clip of that embodiment, FIG. 3B being a sectional view taken along line 3B—3B of FIG. 3A and FIG. 3C illustrating the clip attached to a pair of plug blades.
Figure 3B:
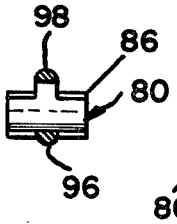
Figure 3C:
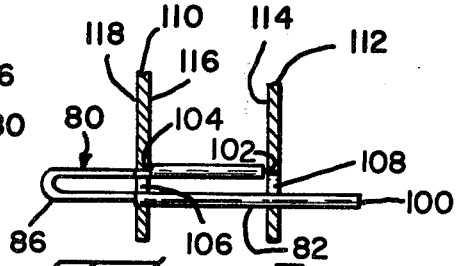

Safety clip 80 of FIGS. 3A, 3B and 3C includes a pair of legs 82 and 84 connected by a bight portion 86 similar to bight portion 56 of clip 50. The bight portion 86 has laterally extending shoulders 88 and 90 to either side of short leg 84 and 92 and 94 to either side of long leg 82. The rounded outer surfaces 96 and 98 on the legs extend, respectively, from end 100 of leg 82 to the bight portion 86 and from end 102 of leg 84 to a lock shoulder 104 located a distance from shoulders 88 and 90 slightly greater than the thickness of a plug blade.

Clip 80 is inserted into the bores 106 and 108 of a pair of blades 110 and 112 extending from a plug like plug 10 illustrated in FIG. 1 by first moving the two legs 82 and 84 toward each other so that the legs touch each other and the ends 100 and 102 can be piloted through the bore 106. Further insertion moves end 100 through bore 108 and end 102 to blade 112. Upon release of the legs they separate and end 102 overlies the inner surface 114 of blade 112, shoulder 104 overlies the inner surface 116 of blade 110 and the lateral bight portion shoulders abut the exterior surface 118 of blade 110.

With clip 80 locked in position on the blades as shown in FIG. 3C shoulders 88, 90, 92 and 94 and end 102 prevent further movement of the clip in the insertion direction and shoulder 104 prevents movement of the clip in the withdrawal direction. The long leg 82 extends through both bores 106 and 108 to orient the clip in place on the blades. This feature is shared in common with all of the embodiments of the invention. The rounded surfaces 96 and 98 on the legs have smooth sliding fits with the interior surfaces of the bores 106 and 108, thereby facilitating insertion of the clip. When locked in the position of FIG. 3C clip 80 is firmly attached to the blades and prevents insertion of the blades into a power outlet socket. The bight portion 86 is compressed and biases the legs against the opposite sides of bore 106, thereby improving the connection with the blades and further preventing accidental removal.

Figure 4A:
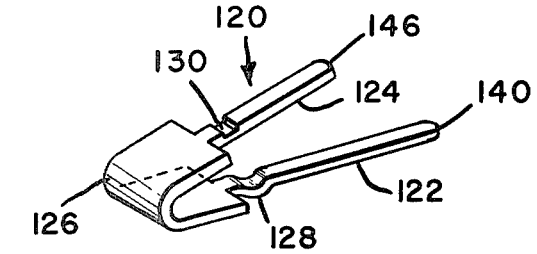
Figure 4B:
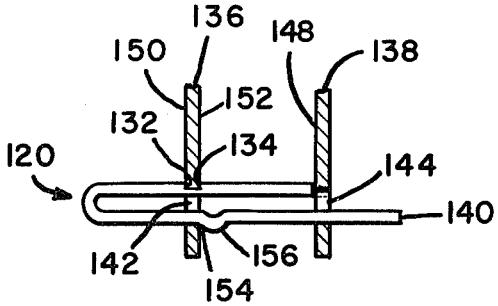

FIGS. 4A and 4B illustrate clip 120 having a pair of legs 122 and 124 connected by a bight portion 126 similar to the bight portions of clips 50 and 80. Long leg 122 includes a locking projection 128 on the outer surface thereof adjacent the bight portion 126 and short leg 124 includes a locking recess 130 on the outer surface thereof adjacent the bight portion. Recess 130 is a short distance closer to the bight portion than locking projection 128. The recess includes a pair of lock side walls 132 and 134 spaced apart a distance slightly greater than the thickness of a line cord plug blade.

Clip 120 is mounted on a pair of contact blades 136 and 138 carried by a line cord plug by bending the legs 122 and 124 toward each other and then moving the end 140 of leg 122 through bores 142 and 144 and also moving end 146 of leg 124 through bore 142 so it is flush with the inner surface 148 of blade 138. The clip is then released so that the spring tension of the bight portion seats the edge of bore 142 into the lock recess 130 with stop surface 132 abutting the outer surface 150 of blade 136 and stop surface 134 abutting the inner surface 152 of the blade. The side 154 of lock projection 128 adjacent bight portion 126 engages the interior surface 152 of blade 136. The rise surface 156 of the locking projection slopes away from the leg 122 to cam the projection past the bore 142 during insertion.

The clip 120 is locked in position on blades 136 and 138 with surface 132 and end 146 preventing further movement of the clip in the insertion direction and surfaces 134 and 154 preventing movement of the clip in the withdrawal direction. In the event of slight movement of the clip further in the insertion direction the lateral shoulders of the bight portion 126 engage blade surface 150 and thereby limit further movement.

Figure 5A:
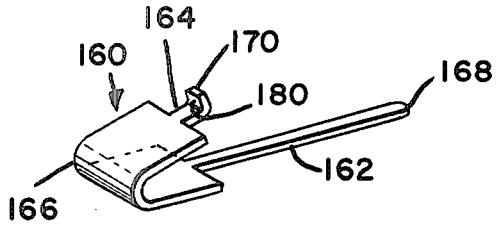
Figure 5B:
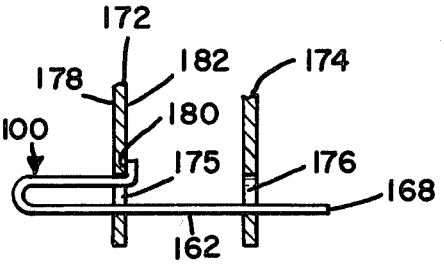

FIGS. 5A and 5B illustrate safety clip 160 having a pair of legs 162 and 164 extending outwardly from a bight portion 156 like the bight portions of safety clips 50, 80 and 120. The bight portion includes lateral shoulders extending to either side of the legs 162 and 164. Long leg 162 extends a distance from the bight portion 156 gerater than the distance between a pair of line cord blades. Short leg 164 extends from bight portion 166 a distance slightly greater than the thickness of a single line cord blade and includes an upwardly bent locking tab 170 at the free end thereof.

The clip 160 is mounted on blades 172 and 174 of a line cord plug by first compressing the bight portion to move the legs together and then piloting the free end 168 of leg 162 through both bores 175 and 176. The locking tab has a vertical height less than the diameter of bore 174 so that upon collapse of the clip the leg 164 and tab may be moved through bore 175. Upon release of the clip the resiliency of the bight portion flexes the legs apart to seat leg 162 against the surfaces of the bores and to move leg 164 against the opposite side of bore 175. In this position, shown in FIG. 5B, the bight portion shoulders extending laterally of the legs and engage the exterior surface 178 of blade 172 to prevent further movement of the clip in the insertion direction. Lock surface 180 of tab 170 engages the interior surface 182 of blade 172 to prevent movement of the clip in the withdrawal direction. The long leg 162 extends through both bores and orients the clip with respect to the blades. Thus, the clip is firmly secured to the blades 172 and 174 and prevents insertion of the blades into an outlet. Removal of the clip from the blades requires depression of the bight portion and then movement in a withdrawal direction. This operation requires strength and manual dexterity beyond the capabilities of a young child.

Figure 6A:
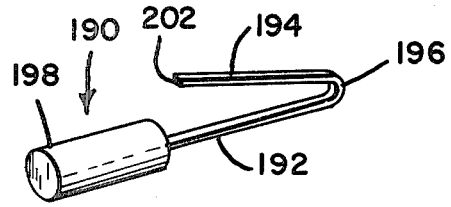
Figure 6B:
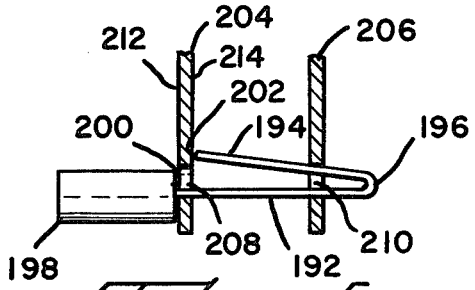

FIGS. 6A and 6B illustrate locking clip 190 which includes a pair of straight legs 192 and 194 connected together by a bight portion 196. As illustrated in FIG. 6A, the legs 192 and 194 normally diverge from each other away from the bight portion. Long leg 192 extends into a cylindrical stop member 198 having a lock surface 200 surrounding the leg and facing toward the bight portion 196. The free end 202 of short leg 194 is spaced away from surface 200 by a distance approximately equal to the thickness of a line cord plug blade.

Clip 190 is mounted on blades 204 and 206 of a line cord plug like plug 10 illustrated in FIG. 1 by first moving the legs close to each other by compressing a bight portion and then piloting the bight portion 196 through bore 208 and bore 210 to move surface 200 flush against the exterior surface 212 of blade 204. The blades are then released and the bight portion 196 moves the end 202 of blade 194 up beyond bore 208 so that it abuts the interior surface 214 of blade 204. In this position long leg 196 extends through both bores and stabilizes the clip on the plug while lock surface 200 prevents further movement of the clip in the insertion direction and end 202 prevents movement of the clip in the withdrawal direction. The resiliency of the bight portion holds legs 192 and 194 against opposite sides of bore 210 to further stabilize the clip in position on the blades. Removal of the clip from the blades requires compression of the legs so that they are brought together and end 202 is lowered below the top of the bore 208. When held down in this position the stop member 198 may then be grasped to pull the clip from the bores.

Figure 7A:
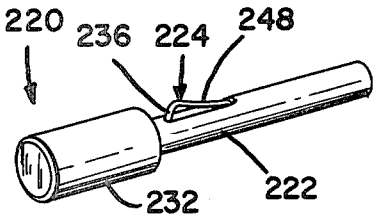
Figure 7B:
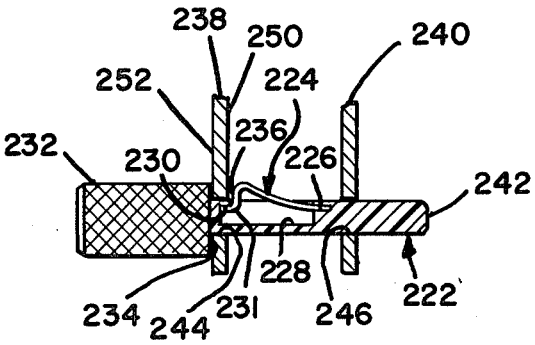

FIGS. 7A and 7B illustrate another embodiment of the invention wherein clip 220 includes a long leg 222 and a short leg 224 secured together with end 226 of the short leg extending into a portion of the long leg at one end of recess 228. The recess includes a lock shoulder 230. The short leg 224 is formed from a resilient material, preferably metal with free end 231 thereof biased against shoulder 230. An expanded cylindrical lock member 232 is formed on the end of long leg 222 adjacent the free end of the short leg and includes a locking surface 234 facing the short leg. The short leg includes a lock surface 236 normally projecting outwardly of recess 228 and spaced from surface 234 a distance slightly greater than the thickness of a line cord plug blade.

Safety clip 220 is secured to blades 238 and 240 of a line cord plug by piloting the free end 242 of long leg 228 into bore 244 and then pushing the clip in the insertion direction to move the end 242 through both bores 244 and 246. The short leg 224 includes a cam surface 248 normally sloping upwardly from recess 228. During insertion this surface engages the interior surface of bore 244 to flex the short leg down into the recess and permit movement of the safety clip to the inserted position. When the cam surface moves out of bore 244 it snaps back from the recess 228 to position the stop surface 236 opposite interior surface 250 of blade 238. In this way, the clip is secured onto the blades 238 and 240 with surface 236 preventing withdrawal movement of the clip and surface 234 preventing further insertion movement of the clip. The long leg 228 extends through both bores and stabilizes the clip. End 231 of the short leg rests on shoulder 230 to prevent flexing of the short leg totally from the recess. In order to remove the safety clip 220 from blades 238 and 240 it is necessary to depress short leg 224 into the recess and then withdraw the long leg from the bores.

With the safety clip 220 in position on the blades it is impossible to insert the blades into an outlet socket sufficiently to engage the contacts. In this way, the electrical device powered by a normal flow of electricity through the blades is deactivated and the desired safety feature is achieved.

While I have illustrated and described a preferred embodiment of my invention, it is understood that this is capable of modification, and I therefore do not wish to be limited to the precise details set forth, but desire to avail myself of such changes and alterations as fall within the purview of the following claims.

I claim:

1. An improved safety plug clip of the type adapted to be locked on the ends of electrical plug contact blades, the clip comprising a long leg, a short leg resiliently connected at one end to the long leg so that the legs normally diverge from each other away from the connection, said clip being sufficiently resilient to permit movement of said legs together to a collapsed position for movement in an insertion direction through axially aligned bores formed through the spaced contact blades of the plug to the locked position, a stop surface on the short leg located between the ends of the long leg for engagement with an interior surface with one of the blades to prevent movement of the clip in one direction from the locked position, and the clip including a second lock surface facing in a direction opposite to that of said first lock surface and engagable with a different blade side to prevent movement of the clip from the locked position in an opposite direction, said long leg extending through the bores in both plug blades.

2. A safety plug clip as in claim 1 wherein said long and short legs are joined by a unitary bight portion, said bight portion biasing the exterior surfaces of said legs against the opposite sides of a line cord plug blade bore when the clip is in the locked position.

3. A safety plug as in claim 2 including at least one shoulder extending laterally of a leg adjacent to the bight portion for engagement with one side of a blade to limit movement of the clip past the inserted position.

4. A safety plug clip as in claim 2 including a stop surface on the free end of the short leg positioned adjacent an interior surface of one of the blades to prevent movement of the clip in a direction toward such blade surface.

5. An improved safety plug as in claim 2 including a lock recess on an exterior surface of one of said legs, said recess including surfaces engagable with the interior and exterior surfaces of a blade for holding the clip in place.

6. A safety plug clip as in claim 2 including a locking dimple on an exterior surface of one of said legs, said dimple including a lock surface facing a blade side and a cam surface facing away from such blade side.

7. A safety plug clip as in claim 2 wherein one of said legs includes a lock surface engagable with one side of a plug blade and wherein the exterior surfaces of said legs are rounded to facilitate movement through said blade bores.

8. A safety plug clip as in claim 2 including a locking extension and a reverse bend connection joining such extension to the end of the short leg away from said connection, said extension having a free end engagable with an interior surface of one of said blades.

9. A safety plug clip as in claim 2 including a stop member on the free end of said long leg, the stop member having a locking surface facing the bight portion, the free end of the short leg defining a stop surface located a distance closer to the bight portion approximately equal to the thickness of a blade whereby when the clip is in a locked position on the plug one blade is confined between the short leg and the stop member so as to prevent movement of the clip in either the insertion or withdrawal directions, said bight portion biasing opposite edges of said legs against the interior sides of the other bore.

* * * * *

UNITED STATES PATENT OFFICE

CERTIFICATE OF CORRECTION

PATENT NO. : 4,204,723

DATED : May 27, 1980

INVENTOR(S) : Jack W. Bloomingdale

It is certified that error appears in the above-identified patent and that said Letters Patent are hereby corrected as shown below:

Claim 1, column 7, line 34 change "stop" to --lock--.

Claim 4, column 8, line 8 change "stop" to --lock--.

Signed and Sealed this

*Twenty-ninth* Day of *July 1980*

[SEAL]

*Attest:*

SIDNEY A. DIAMOND

*Attesting Officer*

*Commissioner of Patents and Trademarks*